US007931275B1

(12) United States Patent
Strickland

(10) Patent No.: US 7,931,275 B1
(45) Date of Patent: Apr. 26, 2011

(54) POKER GAME WITH DICE

(76) Inventor: Larry C. Strickland, Lugoff, SC (US)

( * ) Notice: Subject to any disclaimer, the term of this patent is extended or adjusted under 35 U.S.C. 154(b) by 45 days.

(21) Appl. No.: 12/407,731

(22) Filed: Mar. 19, 2009

(51) Int. Cl.
*A63F 9/04* (2006.01)

(52) U.S. Cl. ..... 273/146; 273/145 A; 273/145 C; 273/145 R; 273/292; D21/372

(58) Field of Classification Search ..... 273/146, 273/145 A, 145 C, 145 R, 292, 145 B, 145 CA; D21/372, 373
See application file for complete search history.

(56) References Cited

U.S. PATENT DOCUMENTS

| | | | | |
|---|---|---|---|---|
| 3,565,442 | A | 2/1971 | Klein | |
| 3,614,105 | A | 10/1971 | Dandini | |
| D262,901 | S | 2/1982 | Vukadinovic | |
| 4,984,797 | A * | 1/1991 | Norsworthy | 273/145 C |
| 5,169,148 | A * | 12/1992 | Wheeler | 273/146 |
| 5,375,845 | A * | 12/1994 | Cooter et al. | 273/292 |
| 6,062,563 | A | 5/2000 | de Keller | |
| 6,135,453 | A * | 10/2000 | Srichayaporn | 273/292 |
| 6,428,005 | B2 | 8/2002 | Au-Yeung | |
| 6,712,360 | B2 | 3/2004 | Yaple | |
| 7,032,901 | B2 | 4/2006 | Perrie et al. | |
| 7,582,011 | B2 * | 9/2009 | Maling | 463/16 |

* cited by examiner

*Primary Examiner* — Benjamin H Layno

(57) ABSTRACT

The present invention features a poker game kit. The present invention also features a method of playing a poker game with a dealer and one, two, or three players. The present invention also features a method of playing a poker game with a dealer and four players.

4 Claims, 8 Drawing Sheets

FIG. 6a: CHART 1
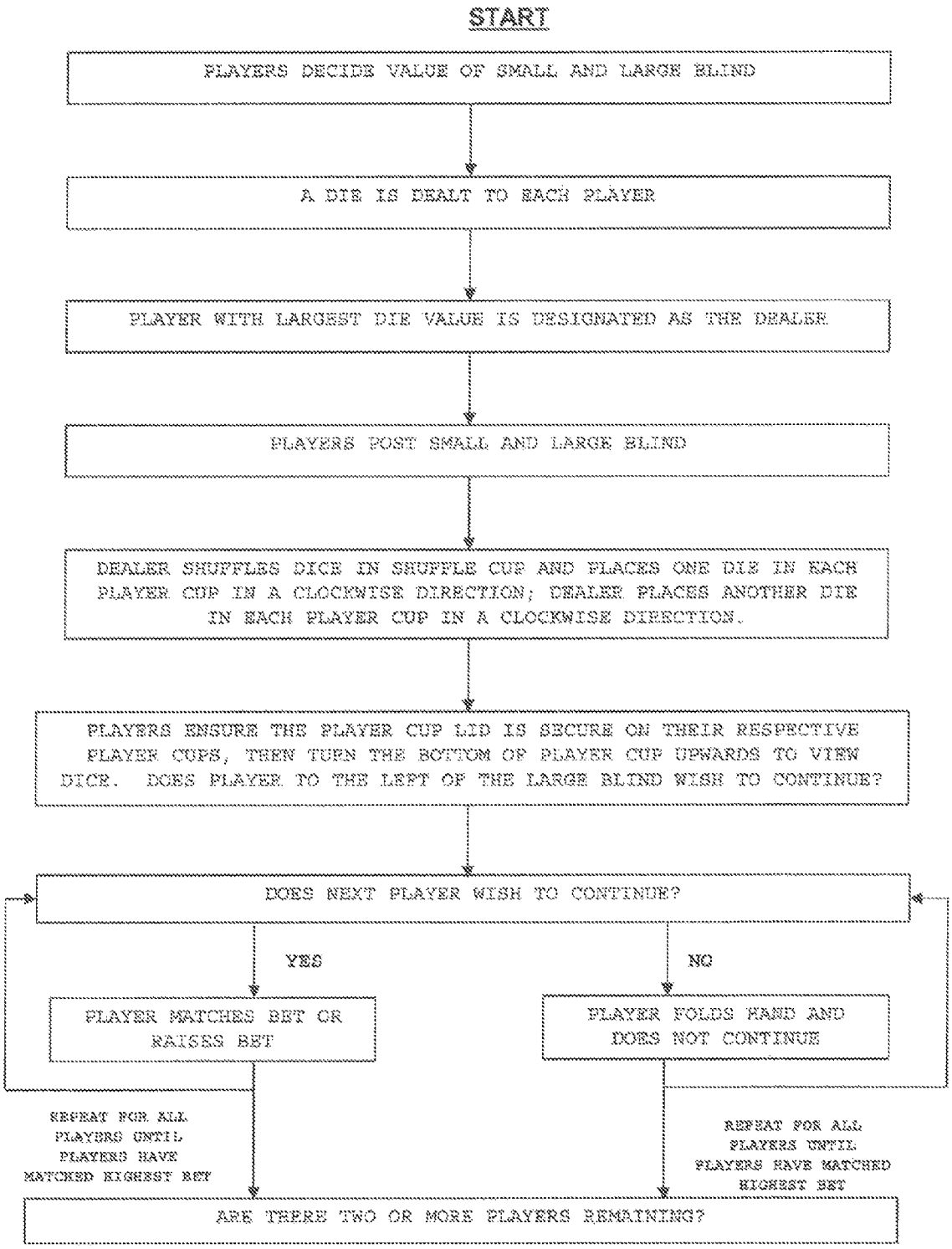

POKER GAME WITH DICE

FIELD OF THE INVENTION

The present invention is directed to a game of chance and amusement. More particularly, the present invention is directed to a poker-like game.

BACKGROUND OF THE INVENTION

The present invention features a poker game kit. The present invention also features a method of playing a poker game (e.g., Carolina Hold 'em) with a dealer and one, two, or three players. The present invention also features a method of playing a poker game with a dealer and four players.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention provides a poker game kit comprising a set of thirteen pyramidal dice having a first pyramidal die, a second pyramidal die, a third pyramidal die, a fourth pyramidal die, a fifth pyramidal die, a sixth pyramidal die, a seventh pyramidal die, an eighth pyramidal die, a ninth pyramidal die, a tenth pyramidal die, an eleventh pyramidal die, a twelfth pyramidal die, and a thirteenth pyramidal die; each pyramidal die having a first face, a second face, a third face, and a fourth face; each face being an equilateral triangle. The poker game kit further comprises a holding tray having a top, a bottom, a front, a back, a left side, and a right side; wherein three flop die slots, one turn die slot, and one river die slot are disposed on the top of the holding tray, wherein the flop die slots, the turn die slot, and the river die slot are for holding a die; a shuffle cup having an open top, wherein the shuffle cup is a cup for shuffling the pyramidal dice; a player cup having an open top and a transparent bottom, wherein the transparent bottom is for revealing the value of the pyramidal dice; a shuffle cup lid having a top and a bottom, wherein the shuffle cup lid is removably attached to the top of the player cup; a player cup lid having a top and a bottom, wherein the player cup lid is removably attached to the top of the player cup, wherein a foam member is disposed on the bottom of the player cup lid, wherein the foam member is for compressing the pyramidal dice inside the player cup such that the dice do not move; a dealer button, wherein the dealer button is for giving to the dealer; and a plurality of chips for betting.

The present invention also provides methods of playing a poker game with a dealer and one, two, or three players comprising the steps of providing the aforementioned poker game kit; the dealer placing two pyramidal dice in each player cup; the dealer placing three dice in the flop die slots disposed on the holding tray; the dealer placing one die in the turn die slot disposed on the holding tray; the dealer placing one die in the river die slot disposed on the holding tray; and each player and dealer determining a poker hand from five of the dice in the holding tray, the player cup, or a combination thereof.

The present invention also provides methods of playing a poker game with a dealer and four players comprising the steps of providing the aforementioned poker game kit; the dealer placing two pyramidal dice in each player cup; the dealer placing one die in a flop die slot disposed on the holding tray; the dealer placing one die in the turn die slot disposed on the holding tray; the dealer placing one die in the river die slot disposed on the holding tray; and each player and dealer determining a poker hand from five of the dice in the holding tray, the player cup, or a combination thereof.

The methods may comprise the step of at least one player making a bet after the dealer places two pyramidal dice in all player cups and before the dealer places one or three dice in the flop die slots disposed on the holding tray.

The methods may comprise the step of at least one player making a bet after the dealer places one or three dice in the flop die slots disposed on the holding tray and before the dealer places one die in the turn die slot disposed on the holding tray.

The methods may comprise the step of at least one player making a bet after the dealer places one die in the turn die slot disposed on the holding tray and before the dealer places one die in the river die slot disposed on the holding tray.

The method may comprise the step of at least one player making a bet after the dealer places one die in the river die slot disposed on the holding tray.

BRIEF DESCRIPTION OF THE DRAWINGS

FIGS. 6*a*, 6*b* and 6*c* is a flowchart of the game play process.

DESCRIPTION OF PREFERRED EMBODIMENTS

Figure 1:
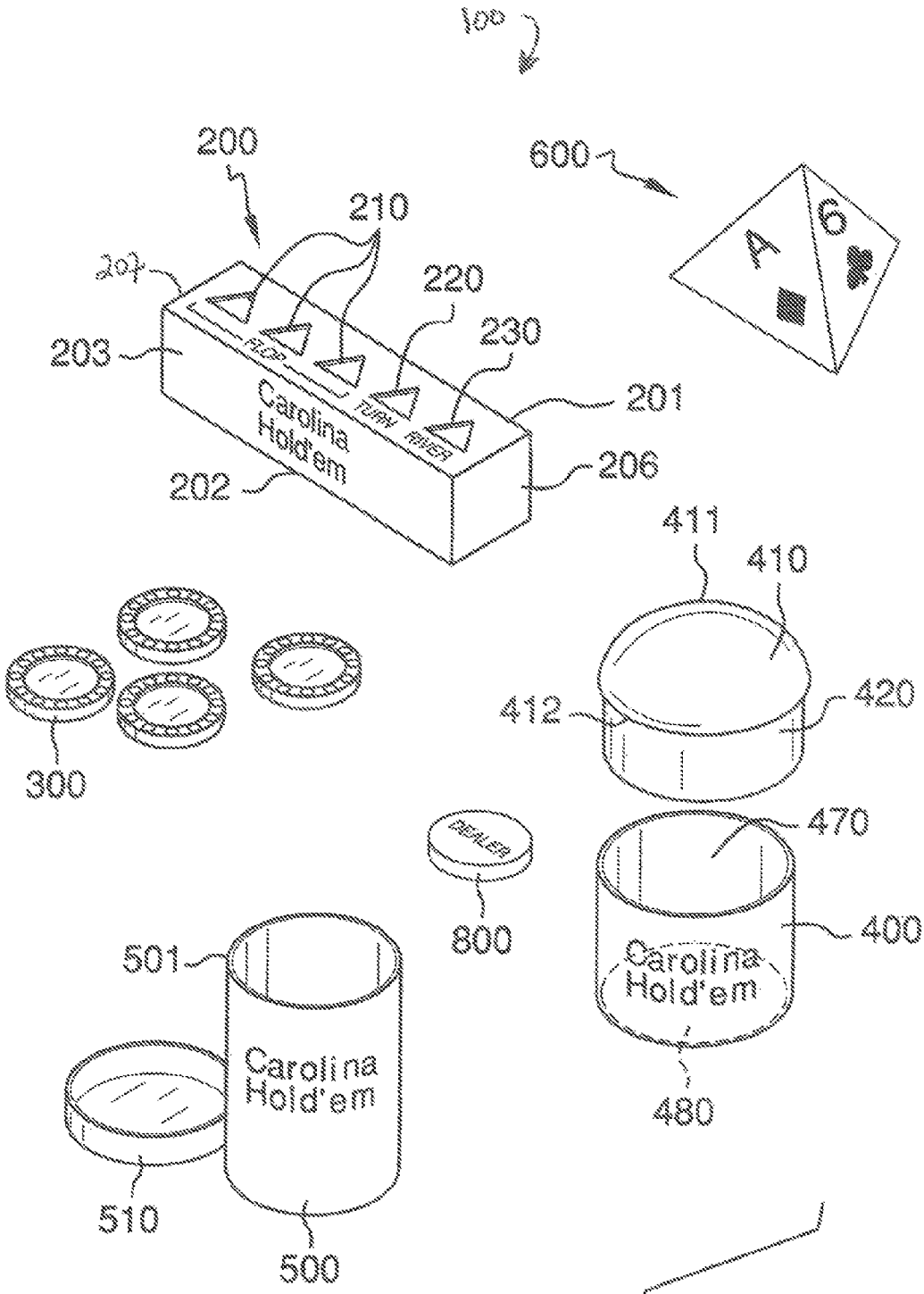
FIG. 1 is a perspective view of the components of the poker game of the present invention, for example the holding tray, chips, a player cup, a pyramidal die, and a shuffle cup.
Figure 2:
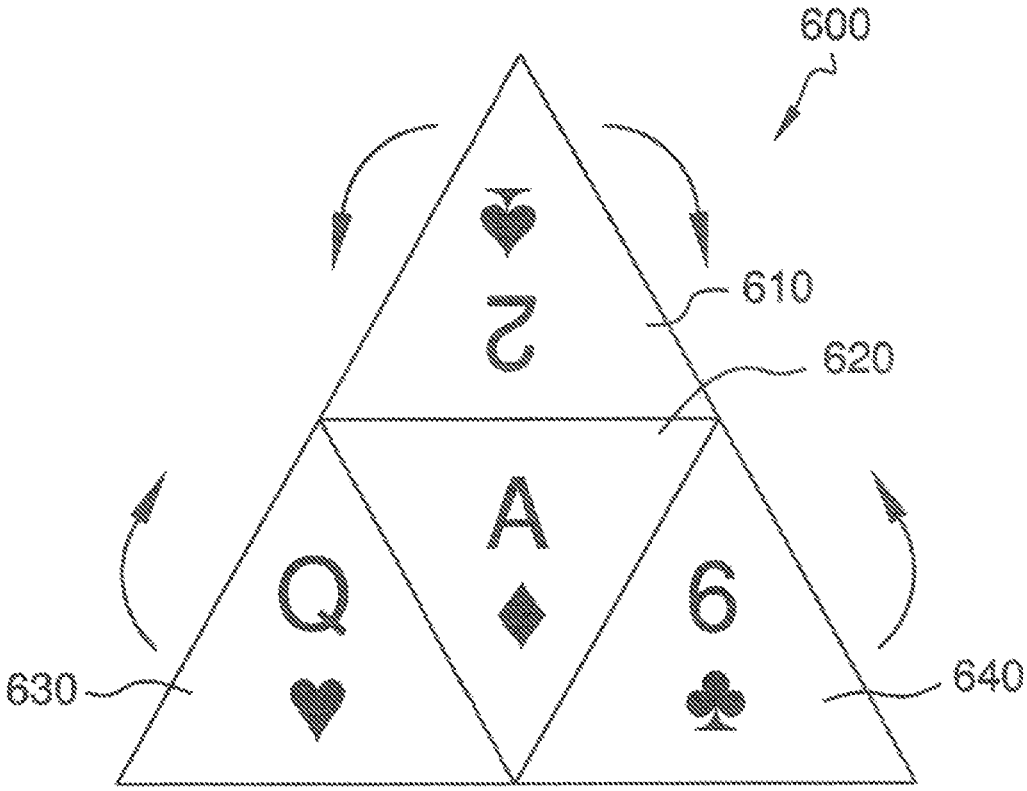
FIG. 2 is an exploded (unfolded) view of an example of a pyramidal die of the poker game of the present invention.
Figure 3:
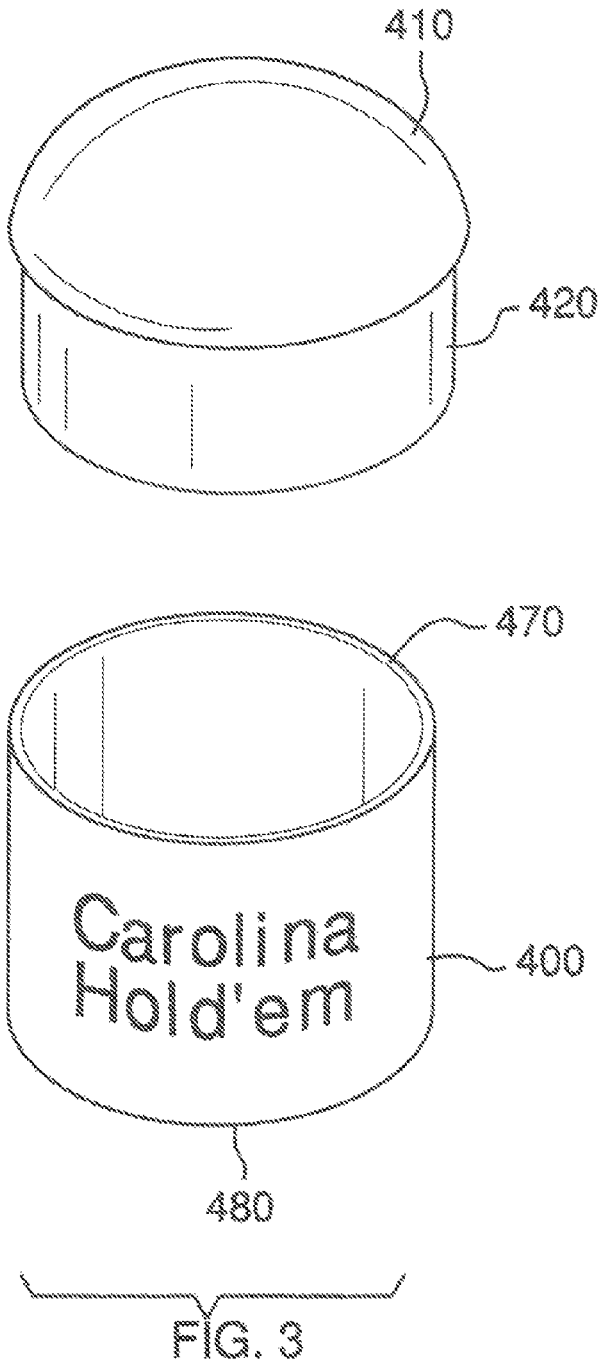
FIG. 3 is a front view of the player cup of the poker game of the present invention.

The following is a listing of numbers corresponding to a particular element refer to herein:

100 poker game kit
200 holding tray
201 top of holding tray
202 bottom of holding tray
203 front of holding tray
206 right side of holding tray
207 left side of holding tray
210 flop die slot
220 turn die slot
230 river die slot
300 chip
400 player cup
410 player cup lid
411 top of player cup lid
412 bottom of player cup lid
420 foam member
470 top of player cup
480 bottom of player cup (e.g., clear plastic)
500 shuffle cup
501 top of shuffle cup
510 shuffle cup lid
600 pyramidal die
610 first face of die
620 second face of die

630 third face of die
640 fourth face of die
800 dealer button

Referring now to FIGS. 1-5, the present invention features a poker game kit 100. The poker game kit 100 comprises a set of thirteen pyramidal dice 600 and a holding tray 200 having a top 201, a bottom 202, a front 203, a back, a left side 207, and a right side 206, wherein three flop die slots 210, one turn die slot 220, and one river die slot 230 are disposed on the top 201 of the holding tray 200, wherein the flop die slots 210, turn die slot 220, and river die slot 230 are for holding a die 600. The poker game kit 100 further comprises a shuffle cup having an open top, wherein the shuffle cup 500 is for shuffling the pyramidal dice 600; a shuffle cup lid 510 having a top and a bottom, wherein the shuffle cup lid 510 can be removably attached to the top of the shuffle cup 500; and a player cup 400 having an open top 470 and a transparent bottom 480, wherein a player cup lid 410 is removably attached to the top 470 of the player cup 400. In some embodiments, the poker game kit 100 comprises a dealer button 800, wherein the dealer button 800 is for giving to the dealer. In some embodiments, the poker game kit 100 comprises a plurality of chips 300 for betting.

The set of thirteen pyramidal dice 600 includes a first pyramidal die, a second pyramidal die, a third pyramidal die, a fourth pyramidal die, a fifth pyramidal die, a sixth pyramidal die, a seventh pyramidal die, an eighth pyramidal die, a ninth pyramidal die, a tenth pyramidal die, an eleventh pyramidal die, a twelfth pyramidal die, and a thirteenth pyramidal die.

In some embodiments, each pyramidal die 600 has a first face 610, a second face 620, a third face 630, and a fourth face 640. In some embodiments, each face is an equilateral triangle. In some embodiments, each face is a 1 inch by 1 inch by 1 inch equilateral triangle.

In some embodiments, each first face 610 of the thirteen pyramidal dice 600 displays a spade, each second face 620 of the thirteen pyramidal dice 600 displays a diamond, each third face 630 of the thirteen pyramidal dice 600 displays a heart, and each fourth face 640 of the thirteen pyramidal dice 600 displays a club. In some embodiments, each first face 610 of the thirteen pyramidal dice 600 displays a first color, each second face 620 of the thirteen pyramidal dice 600 displays a second color, each third face 630 of the thirteen pyramidal dice 600 displays a third color, and each fourth face 640 of the thirteen pyramidal dice 600 displays a fourth color. In some embodiments, the first color is black, the second color is red, the third color is green, and the fourth color is blue. In some embodiments, black corresponds to spades, red corresponds to hearts, green corresponds to diamonds, and blue corresponds to clubs.

The values of the first faces 610, second faces 620, third faces 630, and fourth faces 640 of the pyramidal dice 600 are shown in Table 1. For example, in some embodiments, the first face 610 of the first pyramidal die displays the value "ace" (spades), the second face 620 of the first pyramidal die displays the value "king" (diamonds), the third face 630 of the first pyramidal die displays the value "jack" (hearts), and the fourth face 640 of the first pyramidal die displays the value "five" (clubs).

TABLE 1

| | First Face Spades Black | Second Face Diamonds Green | Third Face Hearts Red | Fourth Face Clubs Blue |
|---|---|---|---|---|
| First Die | Ace | King | Jack | 5 |
| Second Die | King | Queen | 10 | 4 |

TABLE 1-continued

| | First Face Spades Black | Second Face Diamonds Green | Third Face Hearts Red | Fourth Face Clubs Blue |
|---|---|---|---|---|
| Third Die | Queen | Jack | 9 | 3 |
| Fourth Die | Jack | 10 | 8 | 2 |
| Fifth Die | 10 | 9 | 7 | Ace |
| Sixth Die | 9 | 8 | 6 | King |
| Seventh Die | 8 | 7 | 5 | Queen |
| Eighth Die | 7 | 6 | 4 | Jack |
| Ninth Die | 6 | 5 | 3 | 10 |
| Tenth Die | 5 | 4 | 2 | 9 |
| Eleventh Die | 4 | 3 | Ace | 8 |
| Twelfth Die | 3 | 2 | King | 7 |
| Thirteenth Die | 2 | Ace | Queen | 6 |

The poker game kit 100 comprises a player cup 400 having an open top 470 and a transparent bottom 480. The transparent bottom 480 of the player cup 400 is for revealing the value of the pyramidal dice 600 such that the player may see the dice 600 in his player cup 400, whereas the other players cannot see his dice 600. The poker game kit 100 comprises a player cup lid 410 having a top 411 and a bottom 412, wherein the player cup lid 410 can be removably attached to the top 470 of the player cup 400. In some embodiments, a foam member 420 is disposed on the bottom 412 of the player cup lid 410. The foam member 420 is for compressing the pyramidal dice 600 inside the player cup 400 such that the dice 600 do not move.

The present invention also features a method of playing a poker game (e.g., Carolina Hold 'em) with a dealer and one, two, or three players. The method comprises the steps of providing the aforementioned poker game kit 100. The method further comprises the steps of the dealer placing two pyramidal dice 600 in each player cup 400, the dealer placing three dice 600 in the flop die slots 210 disposed on the holding tray 200; the dealer placing one die 600 in the turn die slot 220 disposed on the holding tray 200; the dealer placing one die 600 in the river die slot 230 disposed on the holding tray 200; and each player determining a poker hand from five of the dice 600 in the holding tray 200, the player cup 400, or a combination thereof.

In some embodiments the method further comprises the step of at least one player making a bet after the dealer places two pyramidal dice 600 in each player cup 400 and before the dealer places three dice 600 in the flop die slots 210 disposed on the holding tray 200. In some embodiments the method further comprises the step of at least one player making a bet after the dealer places three dice 600 in the flop die slots 210 disposed on the holding tray 200 and before the dealer places one die 600 in the turn die slot 220 disposed on the holding tray 200. In some embodiments the method further comprises the step of at least one player making a bet after the dealer places one die 600 in the turn die slot 220 disposed on the holding tray 200 and before the dealer places one die 600 in the river die slot 230 disposed on the holding tray 200. In some embodiments the method further comprises the step of at least one player making a bet after the dealer places one die 600 in the river die slot 230 disposed on the holding tray 200.

In some embodiments, the poker game is played with a dealer and four players. In some embodiments, the dealer places only one die 600 in a flop die slot 210 disposed on the holding tray 200 instead of three.

OBJECTIVE AND RULES

The objective of the poker game of the present invention (e.g., Carolina Hold 'em) is to amass the most money and/or betting chips at the end of the game. A game may consist of one or more hands. Typically, a game consists of many hands and ends when one player amasses all of the money and/or betting chips. In some embodiments, bets are placed in a pot. In some embodiments, bets comprise one or more poker chips and/or money.

Figure 4:
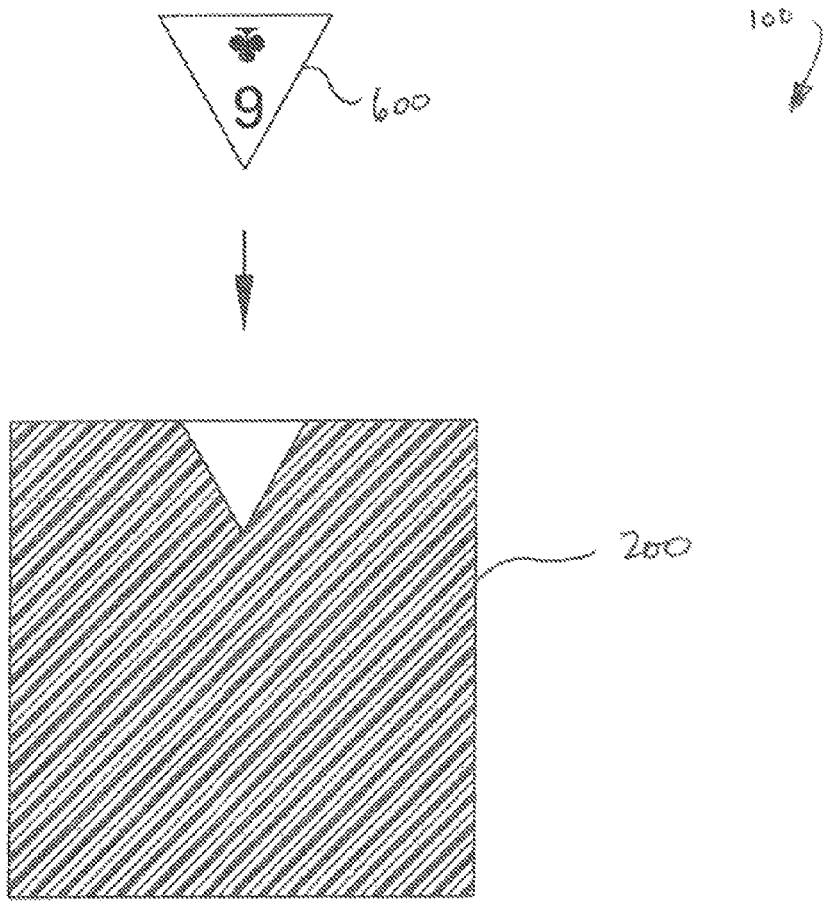
FIG. 4 is a side and cross sectional view of the holding tray of the poker game of the present invention.
Figure 5:
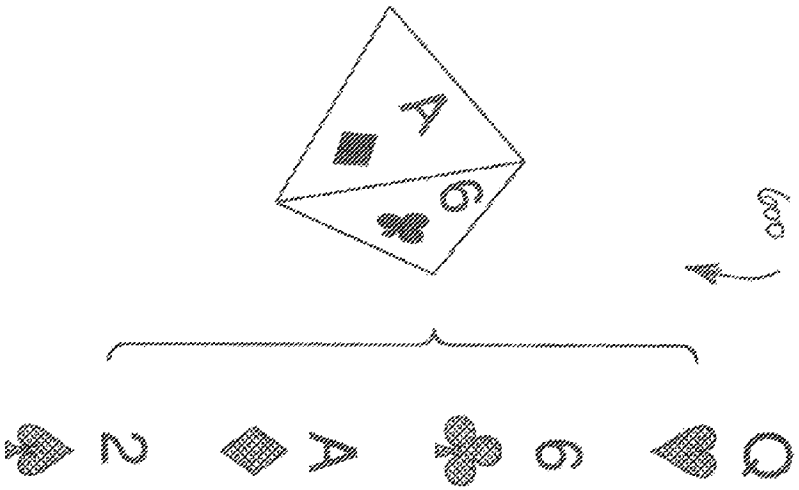
FIG. 5 is a perspective view of an example of a pyramidal die of the poker game of the present invention.
Figure 6B:
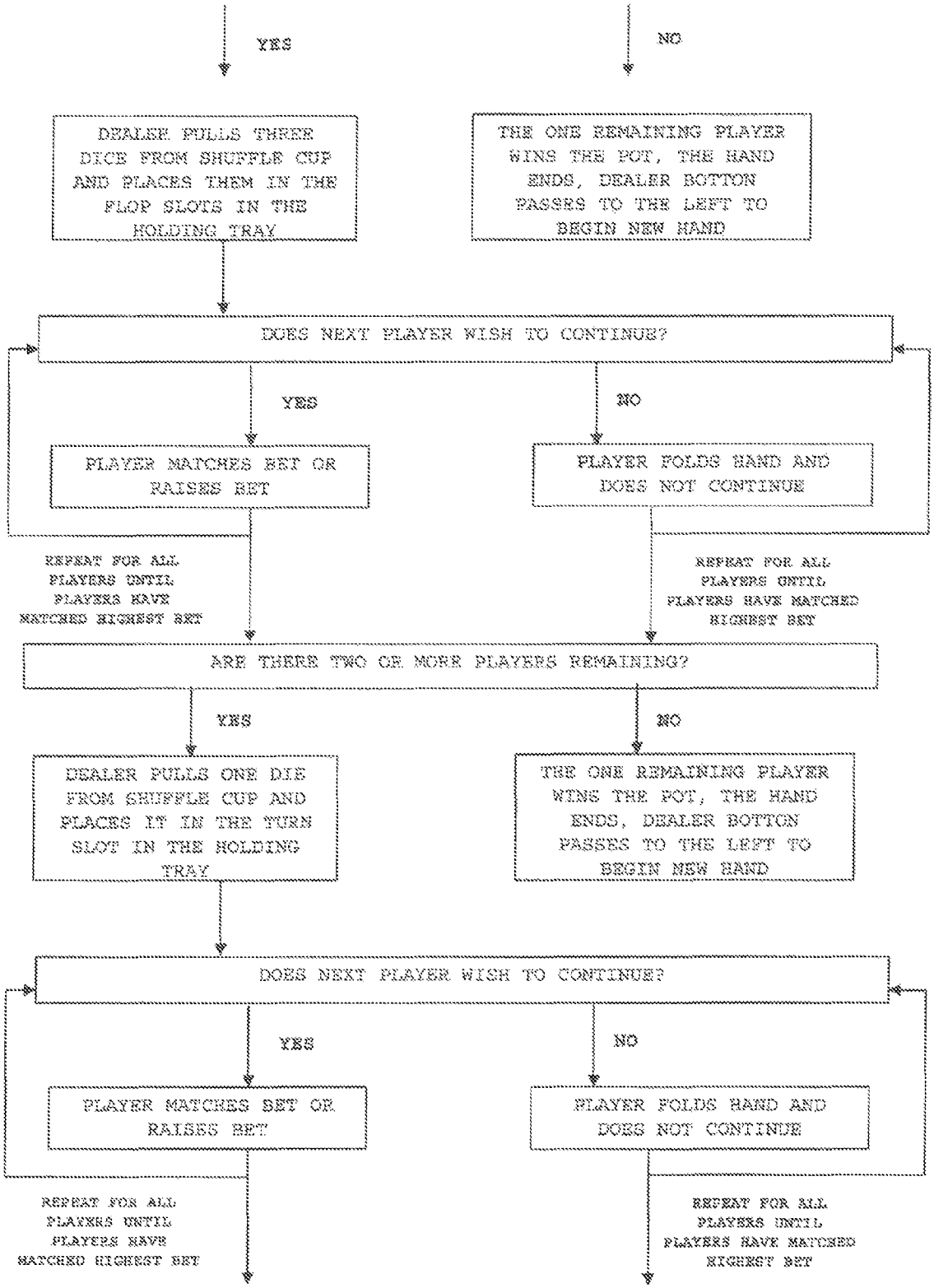
Figure 6C:
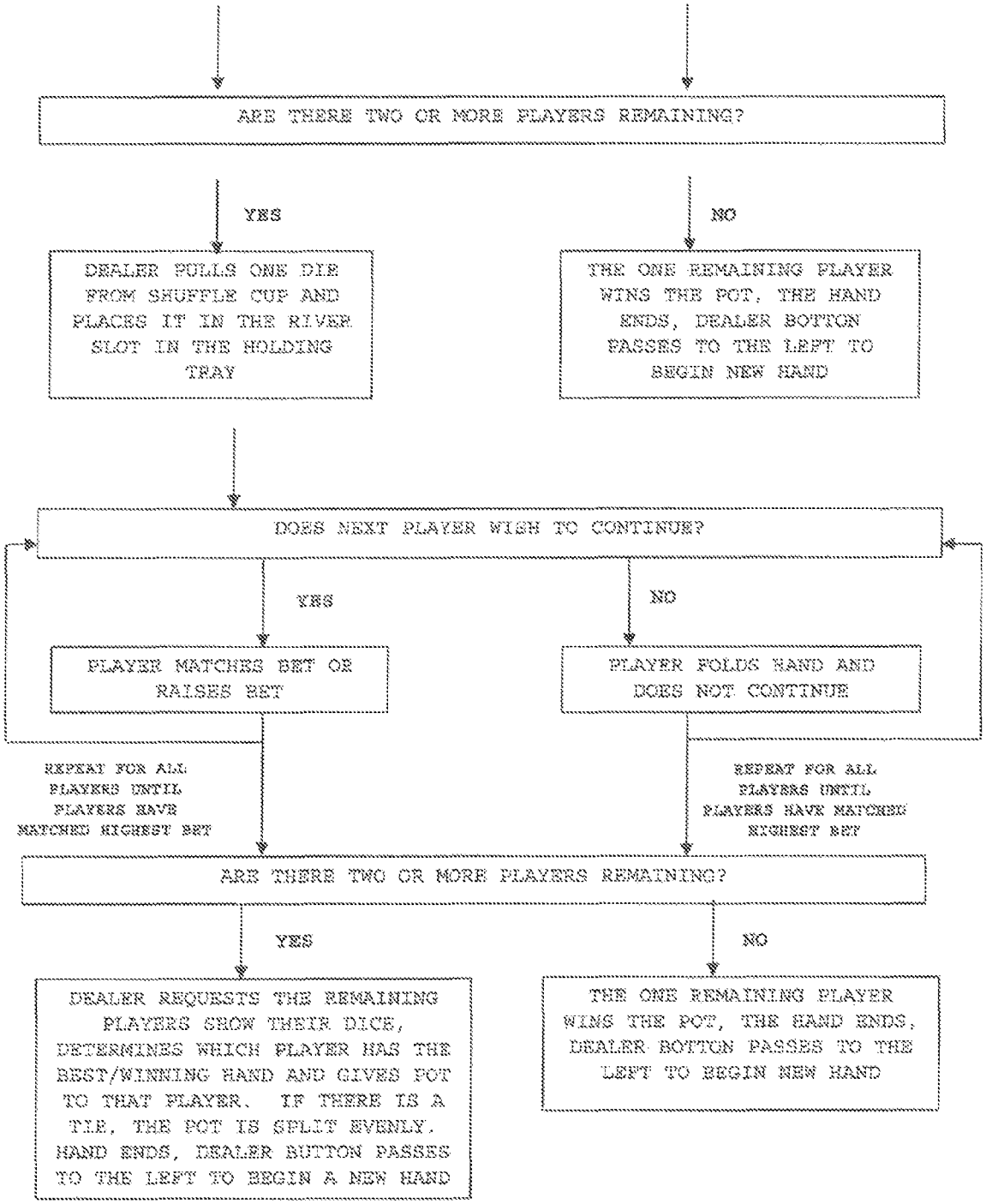

The rules of the poker game of the present invention (e.g., Carolina Hold 'em) are somewhat similar to the Texas Hold 'em poker game (for example, see FIG. 4). Briefly, a hand consists of five dice. The player with the best five-dice hand wins the money and/or chips in the pot. Hands are first ranked by category. Categories are ranked such that a high die (e.g., no pair) is the lowest category followed by one pair, two pair, three of a kind, straight, flush, full house, then straight flush (highest category).

If there are any two hands in the same category, the hands are then ranked by the value of the dice in the hand. The individual values of the dice are ranked such that two is the lowest value followed by three, four, five, six, seven, eight, nine, ten, Jack, Queen, King, then Ace. An ace may be ranked lowest (e.g., below two) when it is part of an "ace-to-five" straight (e.g., ace, two, three, four, five). The suits are typically not ranked. In some embodiments, the players may choose to determine a ranking of the suits. For example, in some embodiments, clubs are lowest followed by diamonds, hearts, then spades (highest).

In some embodiments, the players of Carolina Hold 'em decide to impose a small blind (a forced bet of a certain value) and a big blind (a forced bet larger than the value of the small blind). In some embodiments, a small blind is imposed on the player in the spot directly left of the dealer. In some embodiments, a big blind is imposed on the second player to the left of the dealer.

In some embodiments, the player directly to the left of the dealer places a small blind into the pot and the second player to the left of the dealer places a big blind into the pot.

In some embodiments, the dealer places all thirteen pyramidal dice in the shuffle cup and shakes the cup to shuffle the dice. In a clockwise motion, the dealer places one die in each player cup and repeats this such that each player receives two dice in his/her player cup for his/her respective hand. In some embodiments, each player places his/her player cup lid (having a foam member disposed on the bottom of the player cup lid) on the top of the player cup. The foam member compresses the dice such that they cannot move. The player may then pick up his/her player cup and look into the transparent bottom of the player cup to view the values of his/her dice. The transparent bottom of the player cup allows the player to see the value of his dice whereas the other players cannot.

In some embodiments, a pre-flop round of betting then begins starting with the third player to the left of the dealer (e.g., the player to the left of the big blind player). The betting continues until every player has matched the amount put in by all other active players, put in all of his chips, or folded.

Play continues if at least two players remain after the round of betting. In some embodiments, after the pre-flop betting round, the dealer places three dice in the flop position in the holding tray. Each player determines from the dice in his respective player cup in combination with the flop dice if he wishes to continue play (e.g., placing a bet, check) or fold.

In some embodiments, after the flop round of betting is complete, the dealer places a die in the turn position in the holding tray. Each player determines from the dice in his respective player cup in combination with the flop dice and the turn die if he wishes to continue play or fold.

In some embodiments, after the turn round of betting is complete, the dealer places a die in the river position in the holding tray. Each player determines from the dice in his respective player cup in combination with the flop dice, the turn die, and the river die if he wishes to continue play or fold.

In some embodiments, one player bets and all other players fold. In this case the remaining player is awarded the pot and is not required to show his dice. In some embodiments, two or more players remain after the final betting round. In this case each player determines the best five-dice hand he can make from the seven dice available (e.g., the two dice in his player cup, the flop dice, the hold die, and/or the river die).

In some embodiments, the best hand is shared by more than one player. In this case, the money and/or chips in the pot are split equally among those players. In some embodiments, any extra money/chips from the pot are given to the other players in a clockwise order starting with the player to the left of the dealer button. In some embodiments, the hand involves fewer than five dice, (e.g., two pair, three of a kind). In this case, the values of the remaining dice are used to settle the tie. For example, player #1 with the dice 8-spades, 8-diamonds, 4-spades, 4-clubs, king-diamonds beats player #2 with the dice 8-hearts, 8-clubs, 4-hearts, 4-diamonds, ten-diamonds because the remaining die of player #1's hand is a king, whereas the remaining die of player #2's hand is a ten.

After the hand is over and the pot has been distributed, the dealer gives the dealer button to the player on his left (e.g., dealer button is rotated in a clockwise direction), and that player becomes the dealer for the next hand.

Chart 1 illustrates an example of the game play of the poker game of the present invention.

Example 1

The following example describes a game of Carolina Hold 'em with a four players. Each player chooses one die from the shuffle cup. Player #1 has a "king", player #2 has a "10", player #3 has a "4", and player # 4 has a "2", thus player #1 receives the dealer button and becomes the dealer.

Player #2, who is to the left of the dealer, places the small blind ($5) into the pot. Player #3, who is two players to the left of the dealer, places the big blind ($10) in the pot.

The dealer places all the dice in the shuffle cup and shakes the cup to shuffle the dice. In a clockwise motion, the dealer places one die in each player cup and repeats this such that each player receives two dice for his/her respective hand. The players view the values of the dice by looking through the transparent bottom of their respective player cups. Player #1 has the hand: 5-Diamonds, 5-Spades; Player #2 has the hand: Jack-Diamonds, 8-Clubs; Player #3 has the hand: 2-Spades, 4-Clubs; Player #4 has the hand: King-Hearts, Ace-Spades.

Player #4 places $10 into the pot to match player #3, player #1 places $10 into the pot to match player #3, and player #2 places $5 into the pot to match player #3, player #4, and player #1.

Next, the dealer places three dice in the flop position in the holding tray: Jack-Spades, Ace-Clubs, and 6-Hearts. Player #2 places $10 into the pot. Player #3 places $10 into the pot to match. Player #4 places $15 into the pot to match and raise by $5. Player #1 places $15 into the pot to match, player #2 places $5 more into the pot to match, and player #3 laces $5 more into the pot to match.

Next, the dealer places a die in the turn position in the holding tray: Jack-Clubs. Player #2 places $10 into the pot, player #3 folds, and player #4 places $10 into the pot to match, and player #1 places $10 into the pot to match.

Next, the dealer places a die in the river position in the holding tray: 7-Diamonds. Player #2 places $15 into the pot, and player #4 places $15 into the pot to match, and player #1 places $15 into the pot to match. Player #2 uses the dice Jack-Diamonds, Jack-Spades, Jack-Clubs, Ace-Clubs, and 8-Clubs as his hand. Player #4 uses Ace-Spades, Ace-Clubs, Jack-Spades, Jack-Clubs, and King-Hearts as his hand. Player #1 uses 5-Spades, 5-Diamonds, Jack-Spades, Jack-Clubs, and Ace-Clubs as his hand. Because Player #2 has a three-of-a-kind, he beats player #4 and player #1 who have two pairs. The pot is given to player #2 and the dealer gives the dealer button to player #2.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A poker game kit comprising:

(a) a set of thirteen pyramidal dice having a first pyramidal die, a second pyramidal die, a third pyramidal die, a fourth pyramidal die, a fifth pyramidal die, a sixth pyramidal die, a seventh pyramidal die, an eighth pyramidal die, a ninth pyramidal die, a tenth pyramidal die, an eleventh pyramidal die, a twelfth pyramidal die, and a thirteenth pyramidal die; each pyramidal die having a first face, a second face, a third face, and a fourth face; each face being an equilateral triangle;

wherein the first face of the first pyramidal die displays the value "Ace of Spades", the first face of the second pyramidal die displays the value "King of Spades", the first face of the third pyramidal die displays the value "Queen of Spades", the first face of the fourth pyramidal die displays the value "Jack of Spades", the first face of the fifth pyramidal die displays the value "10 of Spades", the first face of the sixth pyramidal die displays the value "9 of Spades", the first face of the seventh pyramidal die displays the value "8 of Spades", the first face of the eighth pyramidal die displays the value "7 of Spades", the first face of the ninth pyramidal die displays the value "6 of Spades", the first face of the tenth pyramidal die displays the value "5 of Spades", the first face of the eleventh pyramidal die displays the value "4 of Spades", the first face of the twelfth pyramidal die displays the value "3 of Spades", and the first face of the thirteenth pyramidal die displays the value "2 of Spades";

wherein the second face of the first pyramidal die displays the value "King-Diamonds", the second face of the second pyramidal die displays the value "Queen-Diamonds", the second face of the third pyramidal die displays the value "Jack-Diamonds", the second face of the fourth pyramidal die displays the value "10-Diamonds", the second face of the fifth pyramidal die displays the value "9-Diamonds", the second face of the sixth pyramidal die displays the value "8-Diamonds", the second face of the seventh pyramidal die displays the value "7-Diamonds", the second face of the eighth pyramidal die displays the value "6-Diamonds", the second face of the ninth pyramidal die displays the value "5-Diamonds", the second face of the tenth pyramidal die displays the value "4-Diamonds", the second face of the eleventh pyramidal die displays the value "3-Diamonds", the second face of the twelfth pyramidal die displays the value "2-Diamonds", and the second face of the thirteenth pyramidal die displays the value "Ace-Diamonds";

wherein the third face of the first pyramidal die displays the value "Jack-Hearts", the third face of the second pyramidal die displays the value "10-Hearts", the third face of the third pyramidal die displays the value "9-Hearts", the third face of the fourth pyramidal die displays the value "8-Hearts", the third face of the fifth pyramidal die displays the value "7-Hearts", the third face of the sixth pyramidal die displays the value "6-Hearts", the third face of the seventh pyramidal die displays the value "5-Hearts", the third face of the eighth pyramidal die displays the value "4-Hearts", the third face of the ninth pyramidal die displays the value "3-Hearts", the third face of the tenth pyramidal die displays the value "2-Hearts", the third face of the eleventh pyramidal die displays the value "Ace-Hearts", the third face of the twelfth pyramidal die displays the value "King-Hearts", and the third face of the thirteenth pyramidal die displays the value "Queen-Hearts";

wherein the fourth face of the first pyramidal die displays the value "5-Clubs", the fourth face of the second pyramidal die displays the value "4-Clubs", the fourth face of the third pyramidal die displays the value "3-Clubs", the fourth face of the fourth pyramidal die displays the value "2-Clubs", the fourth face of the fifth pyramidal die displays the value "Ace-Clubs", the fourth face of the sixth pyramidal die displays the value "King-Clubs", the fourth face of the seventh pyramidal die displays the value "Queen-Clubs", the fourth face of the eighth pyramidal die displays the value "Jack-Clubs", the fourth face of the ninth pyramidal die displays the value "10-Clubs", the fourth face of the tenth pyramidal die displays the value "9-Clubs", the fourth face of the eleventh pyramidal die displays the value "8-Clubs", the fourth face of the twelfth pyramidal die displays the value "7-Clubs", and the fourth face of the thirteenth pyramidal die displays the value "6-Clubs";

(b) a holding tray having a top, a bottom, a front, a back, a left side, and a right side; wherein three flop die slots, one turn die slot, and one river die slot are disposed on the top of the holding tray, wherein the flop die slots, the turn die slot, and the river die slot are for holding a die;

(c) a shuffle cup having an open top, wherein the shuffle cup is a cup for shuffling the pyramidal dice, wherein a shuffle cup lid having a top and a bottom is removably attached to the top of the player cup;

(d) a player cup having an open top and a transparent bottom, wherein the transparent bottom is for revealing the value of the pyramidal dice;

(e) a player cup lid having a top and a bottom, wherein the player cup lid is removably attached to the top of the player cup, wherein a foam member is disposed on the bottom of the player cup lid, wherein the foam member is for compressing the pyramidal dice inside the player cup such that the dice do not move;

(e) a dealer button, wherein the dealer button is for giving to the dealer; and (f) a plurality of chips for betting.

2. The poker game kit of claim 1, wherein a shuffle cup lid is removably attached to the top of the shuffle cup.

3. The poker game kit of claim 1, wherein each first face of the thirteen pyramidal dice displays a first color, each second face of the thirteen pyramidal dice displays a second color, each third face of the thirteen pyramidal dice displays a third color, and each fourth face of the thirteen pyramidal dice displays a fourth color.

4. The poker game kit of claim 3, wherein the first color is black, the second color is red, the third color is green, and the fourth color is blue.

* * * * *